United States Patent [19]

Bauer

[11] 3,956,198

[45] May 11, 1976

[54] LIQUID LAUNDRY WASHING-AID

[75] Inventor: Henry Bauer, Miraleste, Calif.

[73] Assignee: Days-Ease Home Products Corporation, North Hollywood, Calif.

[22] Filed: Aug. 27, 1973

[21] Appl. No.: 391,602

Related U.S. Application Data

[63] Continuation-in-part of Ser. No. 315,379, Dec. 15, 1972, abandoned, which is a continuation-in-part of Ser. No. 4,090, Jan. 19, 1970, abandoned.

[52] U.S. Cl. ..... 252/542; 252/153; 252/546; 252/DIG. 14; 252/DIG. 17

[51] Int. Cl.[2] ..... C11D 1/34; C11D 3/33

[58] Field of Search ..... 252/139, 153, 527, 526, 252/546, DIG. 14, DIG. 17, 542

[56] References Cited

UNITED STATES PATENTS

| | | | |
|---|---|---|---|
| 3,232,880 | 2/1966 | Mausner | 252/527 |
| 3,265,625 | 8/1966 | Grob | 252/546 |
| 3,393,154 | 7/1968 | Treitler | 252/523 |

*Primary Examiner*—Herbert B. Guynn
*Attorney, Agent, or Firm*—William H. Pavitt, Jr.

[57] ABSTRACT

A washing-aid composition suitable for removal of stains and soil from delicate fabrics which are deleteriously affected by alkaline pH conditions which contains a phosphate ester surfactant, an alkali metal salt of an aminopolyacetic acid in an amount sufficient to essentially neutralize the surfactant to a pH of about 7, a water miscible organic solvent in an amount sufficient to solubilize organic borne stains and dirt, and water in an amount sufficient to solubilize the aminopolyacetic acid salt.

18 Claims, No Drawings

LIQUID LAUNDRY WASHING-AID

This is a continuation-in-part of U.S. application Ser. No. 315,379, filed Dec. 15, 1972, which is in turn a continuation-in-part of U.S. application Ser. No. 4,090, filed Jan. 19, 1970, both now abandoned.

In cleaning operations involving the removal of stains and dirt from fabrics, the nature of the cleaning operation has generally been tailored to some extent to suit the nature of the stain or dirt being removed. Thus, in the case of organic-borne stains, such as grease spots, it may be necessary to dry clean the fabric by treatment with an appropriate solvent or to first treat the spotted area with a solvent prior to laundering in an aqueous system. Inorganic forms of dirt are generally removed simply by washing the fabric in an aqueous system containing a suitable detergent.

Frequently, soiled fabrics contain stains and dirt of both organic and inorganic origin which makes cleaning difficult since the organic-borne stains and dirt may coat the stains and dirt of inorganic origin and, thereby, make their removal through washing in an aqueous system more difficult. In this instance, there may be no practical way to isolate the organic-borne stains and dirt from those of inorganic origin. For example, it is not possible in this situation to treat an isolated spot, e.g., a grease stain, in one manner and to then complete the cleaning operation by treating the remainder of the fabric in a different manner, e.g., washing in an aqueous system.

In providing a solution to the aforementioned problem, it would be desirable to have a means of treating a fabric so as to remove stains and dirt of both organic and inorganic origin which could be practiced simply in a home-washing operation without the need for special equipment, etc. Further, since many fabrics are quite delicate and are adversely affected by excess alkalinity, it would be desirable to have a means which could be utilized to remove stains and dirt of both organic and inorganic origin from such delicate fabrics. Lastly, it would be desirable to perform these operations without presoaking the fabric in an irritating enzymatic presoak composition or a presoaking composition containing gross quantities of water-polluting phosphates.

In accord with the present invention, a composition is provided which functions in a unique manner to incorporate the attributes of both dry cleaning and laundering. In its attributes of dry cleaning, the composition functions to remove stains and dirt of organic origin. In addition, the attributes of laundering provided by the composition make for the removal of stains and dirt of inorganic origin.

Since the attributes of both dry cleaning and laundering are embodied in the same composition, the entire fabric surface may be treated with the dry cleaning attributes contributed by the composition, thereby, enhancing the attributes of laundering provided by the composition. By removing organic-borne stains and dirt which may coat the stains and dirt of inorganic origin, the material of inorganic origin is then more readily removed through treatment with an aqueous system containing a surfactant.

The composition of the invention is essentially neutral, having a pH of about 7. Thus, in addition to combining the attributes of dry cleaning with those of laundering, the composition is suitable for use on delicate fabrics such as silk, wool, fine cottons, etc.

The present composition may be described as a washing-aid which describes usage of the composition in a concentrated form as a liquid detergent or its preferred usage as an adjunct to conventional laundering in an aqueous system. In the latter usage, the composition may be added in any suitable quantity to an aqueous system containing a conventional detergent with the added composition serving to facilitate the removal of stains and dirt of mixed origin, i.e., both organic and inorganic, on the surface of the material being cleaned.

The present washing-aid composition contains a phosphate ester surfactant having the formula $$[RO(CH_2CH_2O)_n]_y\overset{\overset{\displaystyle O}{\|}}{P}(OM)_x$$

in which R is a $C_8$–$C_{20}$ alkylphenyl group or a $C_8$–$C_{20}$ alkyl group. $n$ is a number from about 7 to 50, $y$ is a whole number from 1 to 3, $x$ is 0, 1 or 2, and the sum of $x$ and $y$ in the above formula is equal to 3. $M$ is a hydrogen, sodium or an ammonium ion. The described surfactant is present in the composition in a small effective amount which is sufficient to emulsify organic-borne stains and dirt.

Also present in the composition is an alkali metal salt of an aminopolyacetic acid. The aminopolyacetic acid is present in an amount sufficient to essentially neutralize the surfactant to a pH of about 7. Thus, the resulting composition is very mild and may be used in the removal of stains and dirt from fabrics such as silk, wool, and fine cottons which are deleteriously affected by high alkalinity.

In addition, the composition contains a water miscible organic solvent and also water with the water being present in an amount sufficient to solubilize the aminopolyacetic acid salt, e.g., up to about 10 percent by weight of water or greater. The water miscible solvent is present in the composition in an amount sufficient to solubilize organic-borne stains and dirt and to remove the organic coating from inorganic stains and soil. The water miscible solvent, thereby, functions somewhat in the manner of a dry-cleaning solvent even though the overall system is aqueous. By removing organic-borne stains and dirt which may coat stains and dirt of inorganic origin, the presence of the solvent assists in the removal of inorganic stains and dirt by the aminoacetic acid salt. Thus, the function of the solvent in the composition is directly involved with removal of stains and dirt of both organic and inorganic origin.

In addition, the cleaning aid composition may contain an alkyl aryl polyether alcohol nonionic detergent This ingredient may be present, if desired, in an amoun which is sufficient to improve the wetting ability of the phosphate ester surfactant. Still other ingredient which may be present are a small quantity of a soil-sus pending agent and a small quantity of an optical bright ener as well as minor quantities of suitable colorants o perfuming agents.

Preferably, the composition of the invention contain the aforementioned ingredients in the following per centages:

about 2.0% of the free acid form, and metal or am monium salt form, of a phosphate ester surfactan about 3.0% of an alkali metal salt of an aminopoly acetic acid; and about 4.0% of a water miscible active organic solvent having a low evaporation rate.

Optionally, the composition of the invention may include one or more of the following components which, on the basis of weight may comprise about:

10.0% of an alkyl aryl polyether alcohol nonionic detergent;

0.1% of a soil-suspending agent;

0.1% of an optical brightener; and minor proportions of suitable colorants and perfuming agents if desired.

As indicated above, the completed compositions are characterized by a pH of about 7.0 ± 0.2.

An exemplary commercially available phosphate ester surfactant, in the free acid form, is that made and sold under the trade name QS-30 by Rohm and Haas. In addition, the phosphate adducts of nonylphenol plus 9 moles ethylene oxide and tridecyl alcohol plus 7 moles ethylene oxide are other specific examples of the broad class of phosphate ester surfactants which are suitable for carrying forth the present invention. Further, the article "Phosphate Surfactants" authored by Mayhew et al. occurring at pages 55–58 of Soap and Chemical Specialties, April 1962, is incorporated by reference herein for a more detailed teaching of phosphate surfactants suitable for the practice of the present invention.

Suitable alkali metal salts of aminopolyacetic acids that can be utilized as chelating agents, and as importantly as neutralizing agents for the phosphate ester surfactants, comprise, for example, the sodium salts of ethylenediaminetriacetic acid ($Na_4EDTA$), diethylenetriaminepentacetic acid ($Na_5DTPA$), and nitrilotriacetic acid ($Na_3NTA$).

Suitable water miscible active organic solvents can be selected from virtually any alcohol, glycol, or glycol ether, for example, which has a sufficiently low rate of evaporation to preclude the evaporation thereof from the concentrated composition, or working solution thereof, during normal conditions and temperatures associated with the preparation, handling and utilization of the liquid cleaning-aid compositions. In this regard, and merely by way of example, one such solvent having properties falling within the above parameters is ethylene glycol n-butyl ether. Other suitable solvents include ethylene glycol, propylene glycol, hexylene glycol, etc. and glycol ethers, other than the foregoing, such as the methyl butyl, hexyl, etc. glycol ethers.

Alkyl aryl polyether alcohol nonionic detergents suitable for use in the invention, for enhancing the wetting ability of the phosphate ester emulsifier, are exemplified by a series of products made and sold under the trade name Triton X-100; Triton X-102 and Triton X-114, which are understood to have 7–13 ethylene oxide groups. The latter is understood to be octylphenoxy polyethoxy ethanol.

Soil-suspending agents can be selected from those which are conventionally utilized, i.e., polyvinylpyrrolidone (PVP), carboxymethylcellulose (CMC), acrylamide polymers, natural gums, etc. individually or as admixtures thereof. Exemplary optical brighteners are the coumarin and stilbene derivatives such as marketed under the trademark Blancophor by General Aniline & Film Corp.

The following examples are included to more specifically illustrate the present invention.

EXAMPLE I

| | Lbs. |
|---|---|
| Free acid form of phosphate ester surfactant (Triton QS-30) | 840 |
| $Na_4EDTA$ | 1260 |
| Ethylene glycol n-butyl ether | 1680 |
| Water to make up 5,000 gallons total | |

EXAMPLE II

| | Lbs. |
|---|---|
| Triton QS-30 | 840 |
| $Na_4EDTA$ | 1260 |
| Ethylene glycol n-butyl ether | 1680 |
| Triton X-114 | 4200 |
| Water to make up 5,000 gallons total | |

EXAMPLE III

To the composition of Example II was added 40 lbs. of Blancophor.

The compositions of Examples I–III when added to working solutions of commercially available household detergents were found to enhance the percent of soil removal and reduce the soil redeposition on test swatches of cotton cloth. In the following table the working solutions of commercially available detergents include detergent A, which is TIDE, a registered trademark of the Proctor & Gamble Company and is understood to be manufactured under U.S. Pat. No. 2,712,529, and detergent B, which is MIRACLE WHITE, a registered trademark of Beatrice Foods Company. Detergent C is a composition prepared in accordance with Example V of U.S. Pat. No. 3,265,625 to Erwin Grob. The concentrations set forth in Table I below are 0.5% by weight and about 0.08% by weight — the latter concentration being equivalent to about 2 liquid ounces per 20 gallons of water. This dilution approximates that encountered in the average top loading washing machine.

TABLE I

| Detergent(s) | Concentration of Product by Weight | % Soil Removal | Soil Redeposition Index |
|---|---|---|---|
| 1. "A" | 0.5% | 26.4% | 96.2 |
| 2. "A" "B" | 0.5% 0.08% | 27.0% | 96.9 |
| 3. "A" Inventive Compo. | 0.5% 0.08% | 27.2% | 95.2 |
| 4. "B" | 0.5% | 16.9% | 90.3 |
| 5. Inventive Compo. | 0.5% | 30.4% | 83.8 |
| 6. "C" (pH about 10.5) | 0.5% | 26.0% | 83.4 |
| 7. "C" (pH adjusted to about 7.0) | 0.5% | 26.2% | 83.3 |

It will be understood that the lower the Soil Redeposition Index the lower amount of soil being redeposited.

From the above data, it will be observed that the composition of the invention was slightly more effective than MIRACLE WHITE when used as a washing-aid in conjunction with TIDE as the primary detergent. Moreover, the composition of the invention was more effective than either MIRACLE WHITE or the Grob composition when used at the same concentration as the primary detergent. Moreover, modification of the Grob composition to a pH of 7.0 did not improve its qualities and it was still observed to be less effective than the composition of the invention.

The test data presented in the Table was obtained in a Terg-O-Tometer test machine using a 15 minute wash with two 5 minute rinses. The machine speed was 150 rpm., the wash water temperature was 120°F., and the water hardness was 150 ppm. (parts per million). The fabrics used for each washing test were three 6 × 6 inch swatches of Standard Cotton Soil Cloth of United States Testing Company, Inc. in determining soil removal. Three 6 × 6 inch swatches of Unites States Testing Company Standard Cotton Unsoiled Cloth were used in each test in determining soil redeposition.

The composition identified as the Inventive Composition in Table I was a typical washing-aid composition of the present invention. It contained 2% by weight of the phosphate ester sold under the tradename QS-30, 3% by weight of tetrasodium ethylenediaminetriacetic acid, 4% by weight of ethylene glycol and 10% by weight of the alkyl aryl polyether alcohol sold under the tradename Triton X-114. In addition, the test composition contained 0.1% by weight of polyvinylpyrrolidone as a soil suspending agent, 0.1% by weight of an optical brightener (Blancophor R.G.) and 80.8% by weight of water.

In describing the present composition, reference has been made previously to preferred concentrations, etc. However, inasmuch as the functioning of the various ingedients in the composition is interrelated, it is believed useful to describe the preferred content of the ingredients with respect to the weight of the phosphate surfactant. As thus described, treating the content of the phosphate surfactant as a base unit of one, the ingredients may be described in the following weight ratios:

| | Ratio |
|---|---|
| Free acid, Na, $NH_4$, etc., form of phosphate ester surfactant | 1.0 |
| Alkali metal salt of an amino-polyacetic acid | 1.5 |
| Water miscible active organic solvent | 2.0 |
| and optionally | |
| Alkyl aryl polyether alcohol nonionic detergent | 5.0 |
| and further | |
| Soil-suspending agent | 0.05 |
| Optical brightener | 0.05 |

As illustrated by the foregoing, the washing-aid composition of the invention functions to remove stains and dirt of both organic and inorganic origin at a pH which is essentially neutral. Thus, unlike prior compositions which utilize high alkalinity to saponify stains and dirt of organic origin, the present composition may be used for cleaning of delicate materials such as silk, wool or fine cottons which are adversely affected by high pH conditions. Further, the use of a pH which is essentially neutral is advantageous in removing protein-based stains such as milk, cheese, perspiration, etc., which are denaturated and insolublized by high pH conditions.

The phosphate ester surfactant in the composition, as described previously, also acts as a fabric softener as well as providing the fabric with antistatic properties. Further, the phosphate ester surfactant acts as a dry cleaning agent in assisting the water-miscible solvent in the wetting and penetration of the treated fabrics by the solvent. The phosphate ester surfactant contains only a minute quantity of phosphorous as compared with the gross quantities of inorganic phosphates employed as builders in previous compositions. Thus, the usage of the present washing-aid composition results in a reduction in the environmental contamination caused by the use of inorganic phosphates as builders.

The alkali metal salt of an aminopolyacetic acid, as described previously, acts as a chelating agent in removing stains and dirt of inorganic origin which contain metals. Typical of metals which are present in stains and dirt of inorganic origin are calcium, magnesium, iron and cobalt. Iron, for example, is present in rust stains. The presence of the phosphate ester surfactant, as described, solubilizes the salt of the aminopolyacetic acid in the essentially neutral medium while the aminopolyacetic acid salt serves to neutralize the phosphate surfactant, and vice versa, in providing an essentially neutral composition. Thus, there is an intimate coaction between the phosphate ester surfactant and the alkali metal salt of the aminopolyacetic acid in the functioning of the present composition.

I claim:

1. A washing-aid composition suitable for removal of stains and soil from delicate fabrics which are deleteriously affected by alkaline pH conditions, said composition consisting essentially of:

a phosphate ester surfactant having the formula $$[RO(CH_2CH_2O)_n]_y\overset{\overset{\displaystyle O}{\|}}{P}(OM)_x$$

where R is a $C_8$–$C_{20}$ alkylphenyl group or a $C_8$–$C_{20}$ alkyl group, $n$ is a number from about 7 to 50, $y$ is a whole number from 1 to 3, $x$ is 0, 1 or 2, M is a hydrogen, sodium or ammonium ion, and the sum of $x$ and $y$ is equal to 3;

an alkali metal salt of an aminopolyacetic acid which is a chelating agent for calcium, magnesium, iron and cobalt in an amount of about 1.5 parts by weight for each part of said surfactant sufficient to essentially neutralize said surfactant to a pH of about 7;

a water miscible organic alcohol solvent in an amount of about 2.0 parts by weight for each part of said surfactant sufficient to solubilize organic borne stains and dirt, water in an amount sufficient to solubilize said aminopolyacetic acid salt, said composition having a pH of about 7, and said composition being substantially free from inorganic phosphate builders.

2. The composition of claim 1 wherein the water content is at least about 10 percent by weight sufficient to solubilize said aminopolyacetic acid salt.

3. The composition of claim 1, wherein said solvent has a relatively low evaporation rate under ambient conditions.

4. The composition of claim 1 wherein said solvent is present in an amount ranging up to about 4 percent by weight.

5. The composition of claim 1 wherein said aminopolyacetic acid salt is a sodium salt of ethylenediaminetriacetic acid, diethylenetriaminepentacetic acid or nitrilotriacetic acid.

6. The composition of claim 1 wherein said solvent includes ethylene glycol n-butyl ether.

7. The composition of claim 1 including a small effective quantity of a soil suspending agent.

8. The composition of claim 1 including a small effective quantity of an optical brightener.

9. The composition of claim 1 including a small effective quantity of an optical brightener in an amount of about 0.05 parts by weight for each part of said surfactant.

10. The composition of claim 1 wherein said water miscible organic alcohol solvent is a glycol.

11. The composition of claim 1 wherein said water miscible organic alcohol solvent is a glycol ether.

12. The composition of claim 1 including a small effective quantity of a soil-suspending agent in an amount of about 0.05 parts for each part of said surfactant.

13. The composition of claim 1 including an alkyl aryl polyether alcohol nonionic detergent in an amount sufficient to improve the wetting ability of said surfactant.

14. The composition of claim 1 wherein said nonionic detergent is present in an amount ranging up to about 10 percent by weight.

15. The composition of claim 1 wherein said surfactant is present in an amount ranging up to about 2 percent by weight as the free acid form on the salt thereof.

16. The composition of claim 15 wherein said salt of an aminopolyacetic acid is present in an amount of about 3 percent by weight.

17. The composition of claim 1 including an alkyl aryl polyether alcohol nonionic detergent in an amount of about 5 parts by weight for each part of said surfactant sufficient to improve the wetting ability of said surfactant.

18. The composition of claim 17 wherein said nonionic detergent is octyl phenoxy ethanol having 7–13 ethylene oxide groups per molecule.

* * * * *